United States Patent [19]

Platus

[11] Patent Number: 4,577,812

[45] Date of Patent: Mar. 25, 1986

[54] CENTRIFUGALLY OPERATED MOVING-MASS ROLL CONTROL SYSTEM

[75] Inventor: Daniel H. Platus, Los Angeles, Calif.

[73] Assignee: The United States of America as represented by the Secretary of the Air Force, Washington, D.C.

[21] Appl. No.: 398,281

[22] Filed: Sep. 26, 1973

[51] Int. Cl.[4] ..... F41G 7/00

[52] U.S. Cl. ..... 244/3.21

[58] Field of Search ..... 244/1 SA, 3.21, 3.23, 244/160, 164, 170, 171

[56] References Cited

U.S. PATENT DOCUMENTS 3,437,286 4/1969 Lindley ..... 244/1 SA 3,690,596 9/1972 Durran et al. ..... 244/3.21

3,767,139 10/1973 Fischell ..... 244/1 SA

*Primary Examiner*—Charles T. Jordan

*Attorney, Agent, or Firm*—Donald J. Singer; Joseph E. Rusz; Richard J. Killoren

[57] ABSTRACT

A roll control system for a reentry vehicle having the pay load positioned within the vehicle so as to offset the center of gravity from the aerodynamic axis of the vehicle. A radial mass unbalance is created in the aft end of the vehicle to create a trim angle of attack dependent upon the vehicle roll rate which provides a source of roll torque with the out-of-plane radial center of mass offset. With the use of a mass and spring arrangement, the mass unbalance is controlled by centrifugal force to terminate the roll torque at the prescribed design roll rate.

1 Claim, 5 Drawing Figures

CENTRIFUGALLY OPERATED MOVING-MASS ROLL CONTROL SYSTEM

BACKGROUND OF THE INVENTION

Much effort has been directed toward the development of a simple, lightweight roll control system in order to avoid the impact point errors associated with roll resonance and zero roll of an ablating ballistic reentry vehicle.

One such system is described in the patent to Durran et al U.S. Pat. No. 3,690,596 wherein variable cant angle fins are employed and wherein the cant angles of the fins are regulated by centrifugal forces accompanying an increase in roll rate.

Other systems have canted fixed fins or grooves to spin-up the vehicle to some prescribed roll rate above critical.

All of these systems require fins or grooves external to the missile to provide roll control.

BRIEF SUMMARY OF THE INVENTION

According to this invention, a roll control system is provided which depends entirely upon mass asymmetrics and wherein the roll control system can be contained internal to the vehicle heat shield. The roll control system consists of providing a built-in center of gravity offset in the vehicle and providing a mass unbalance to create a tilted principal axis of inertia in a plane orthogonal to the center of gravity offset. One method for obtaining a center of gravity offset involves displacing the warhead off the aerodynamic axis of symmetry. Since the warhead constitutes a large percentage of the vehicle weight, a relatively small displacement would be required to effect significant mass asymmetries. By providing a movable, spring restrained mass at the aft end of the vehicle, the principal axis tilt is passively controlled by centrifugal force to limit the maximum design roll rate at a predetermined safe level above critical roll rate.

IN THE DRAWING

DETAILED DESCRIPTION OF THE INVENTION

Figure 1:
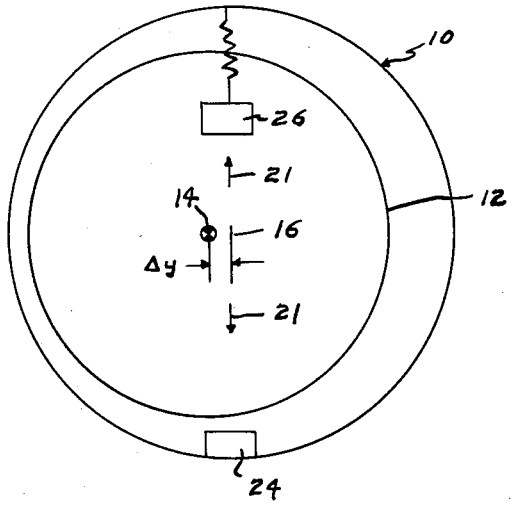
FIG. 1 is a schematic end view of a missile according to the invention.
Figure 2:
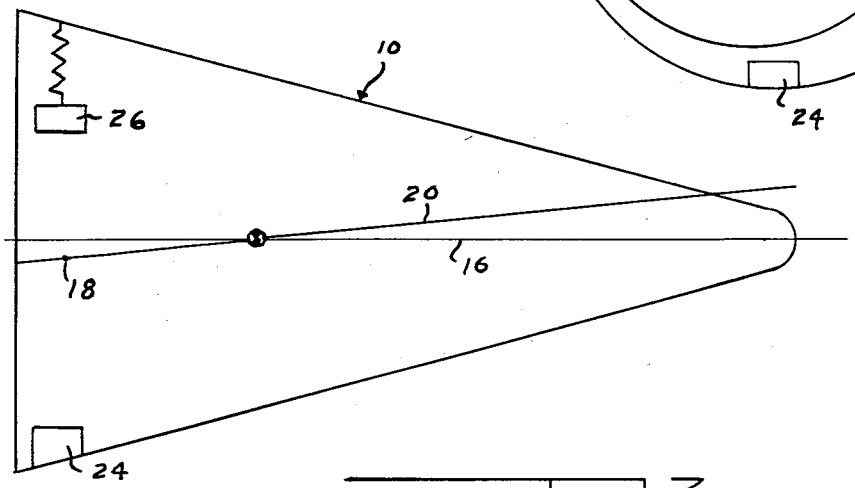
FIG. 2 is a schematic side view of a missile according to the invention.

Reference is now made to FIGS. 1 and 2 of the drawing, which shows a missile 10 with a payload 12 offset from the aerodynamic axis of symmetry 16 such that the center of gravity 14 is positioned a distance $\Delta Y$ from the aerodynamic axis of symmetry 16.

Figure 3:
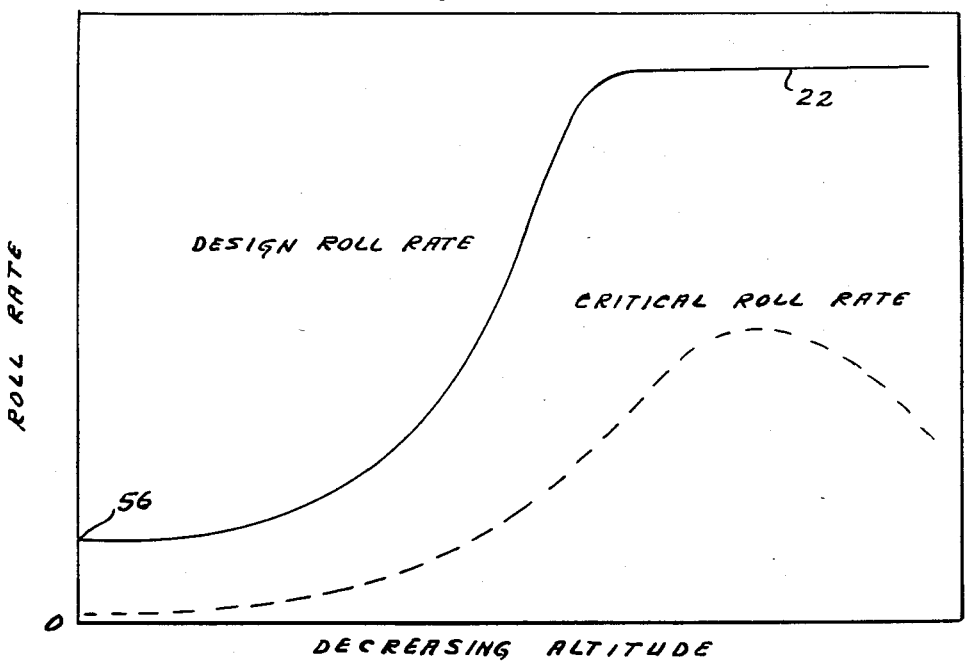
FIG. 3 shows the design and critical roll rate behavior curves for the device of FIGS. 1 and 2.

A mass unbalance is created at the aft end of the missile, as shown in FIG. 2, so that the effective center of mass, at 18, is offset from the aerodynamic axis of symmetry 16. This creates a tilted principal axis of interia 20 in a plane orthogonal to the center of gravity offset. The tilted principal axis of inertia creates a trim angle of attack at supercritical roll rates that in conjunction with the orthogonal center of gravity offset produces a roll torque to drive and maintain the roll rate in a supercritical mode. By means of a movable spring restrained mass, the principal axis of tilt is passively controlled by centrifugal force to limit the maximum roll rate at a predetermined safe level above the critical roll rate as shown in FIG. 3. At the design maximum roll rate, shown at 22 in FIG. 3, the effective center of mass 18 is designed to lie on the aerodynamic axis 16 to provide zero principal axis tilt in a plane orthogonal to the center of gravity offset. The mass unbalance must be such as to permit movement of the effective center of mass 18 on either side of the aerodynamic axis so that the principal axis may be tilted to provide aerodynamic lift in either direction shown by the arrows 21. Thus, the roll rate can be maintained at the design roll rate indicated at 22 in FIG. 3. This is shown schematically in FIGS. 1 and 2, by means of a fixed mass 24 and a spring controlled movable mass 26. Various mass arrangements may be devised to provide this function. One such system is shown in FIG. 4, wherein the masses are arranged such that the movement of the effective center of mass 18 lies approximately in a plane orthogonal to the plane through the aerodynamic axis and the offset center of gravity throughout the entire movement of the control mass.

Figure 4:
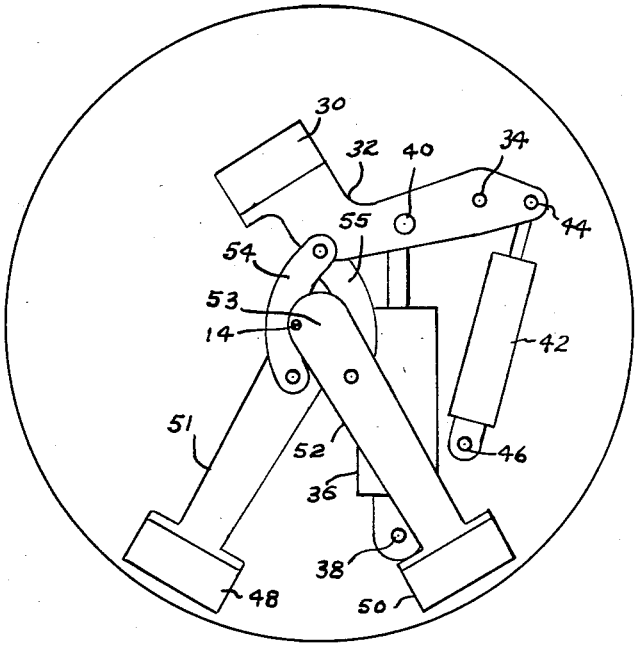
FIG. 4 shows an end view of a mass unbalance system for the device of FIG. 1.
Figure 5:
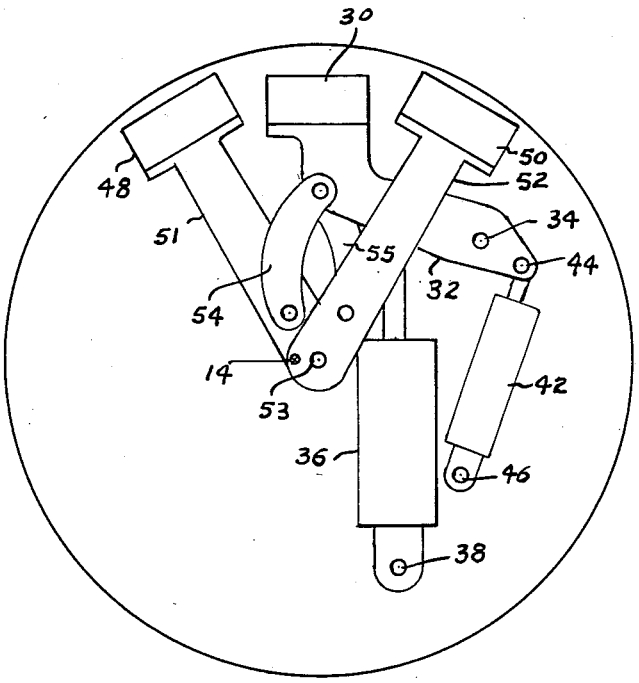
FIG. 5 shows the device of FIG. 4, with the control mass at its fully extended position.

In the device of FIG. 4, a controlling mass 30 is mounted on an arm 32 pivoted at 34. A spring element 36 is secured to a pivot 38 and to the arm 32 at 40. A damper element 42 is secured to arm 32 at 44 and to a pivot 46. A pair of secondary masses 48 and 50 are connected to arms 51 and 52, pivoted at the aerodynamic center 53 and are secured to arm 32 by means of movable link members 54 and 55. With the mass 30 less than either mass 48 or 50, the effective center of mass will be on one side of the aerodynamic center in the position shown in FIG. 4 and on the opposite side of the aerodynamic center of the showing in FIG. 5. At the design maximum roll rate the masses 30, 48 and 50 would lie on the aerodynamic axis. As shown at 56 in FIG. 3, the missile is given an initial roll prior to entry by means of the control systems used before reentry which may be any of the conventional systems used for this purpose and which form no part of this invention.

In one device built and tested, the missile had a length of 74.4 inches and a base radius of 6.0 inches. The nose and frustum $\frac{1}{2}$ cone angle was 4.25 degrees with the radius of the nose being 0.5 inches. The weight of the missile was 154.3 pounds with a center of gravity offset of 0.209 inches. In this device, the controlling mass 30 was 1.0 pound and the secondary masses 48 and 50 were each 1.2 pound. The spring constant for spring 36 was 790 pounds/in with a preload of 400 pounds. The damping constant was 400 pounds-sec/in. In this device, the roll control system effective stroke-weight was 19.2 in-lb and the design equilibrium roll rate was 23.6 rps. The principal axis tilt range was 0.25 degrees to −0.18 degrees.

In the flight test, the entry velocity was 25,200 ft/sec with a reentry roll rate of 4.6 rps and a flight path angle of 6.0 degrees.

In the operation of the device during reentry the trim angle of attack induced by the principal axis tilt and built in orthogonal center of gravity offset causes the roll rate to increase. At some predetermined roll rate, set by the spring preload, centrifugal force acting on the controlling mass causes it to move radially outward, pulling the secondary masses with it, to thereby reduce the mass unbalance and principal axis of tilt. The roll rate increases and the control mass continues to move outward until the initial mass unbalance and principal axis tilt are reduced to zero. Any further increase in roll rate from extraneous sources causes a mass unbalance and principal axis tilt in the opposite direction, which creates a negative roll torque that drives the roll rate back toward equilibrium roll rate. The control system acts like a governor to maintain a constant equilibrium roll rate.

There is thus provided a roll control system for a reentry missile wherein the roll control system can be contained entirely within the missile heat shield.

I claim:

1. A roll control system for a reentry missile comprising: means for offsetting the center of gravity from the aerodynamic axis of said missile; a roll control mass assembly positioned at the aft end of said missile within the heat shield; said roll control mass assembly including means for tilting the principal axis of inertia of said missile in a plane orthogonal to the center of gravity offset of the missile; said tilting means including means for controlling the tilt of the principal axis of inertia as a function of roll rate of said missile at a predetermined level above the critical roll rate.

* * * * *